US005468516A

United States Patent [19]

Yamashita et al.

[11] Patent Number: 5,468,516

[45] Date of Patent: Nov. 21, 1995

[54] PROCESS FOR PRODUCING NONIONIC DETERGENT GRANULES

[75] Inventors: Hiroyuki Yamashita; Hiroyuki Kondo; Kouichi Hatano; Katsunori Nakano; Kouji Toyoda; Takashi Senzaki, all of Wakayama, Japan

[73] Assignee: Kao Corporation, Tokyo, Japan

[21] Appl. No.: 274,563

[22] Filed: Jul. 13, 1994

Related U.S. Application Data

[63] Continuation of Ser. No. 878,452, May 5, 1992, abandoned.

[30] Foreign Application Priority Data

| | | | |
|---|---|---|---|
| May 17, 1991 | [JP] | Japan | 3-112926 |
| May 17, 1991 | [JP] | Japan | 3-112927 |
| May 17, 1991 | [JP] | Japan | 3-112928 |
| Aug. 2, 1991 | [JP] | Japan | 3-194265 |
| Aug. 2, 1991 | [JP] | Japan | 3-194266 |
| Aug. 2, 1991 | [JP] | Japan | 3-194267 |
| Dec. 4, 1991 | [JP] | Japan | 3-320517 |

[51] Int. Cl.[6] ..... C11D 1/66; C11D 11/00; B05D 1/12

[52] U.S. Cl. ..... 427/180; 427/215; 427/220; 252/89.1; 252/140; 252/174; 252/174.13; 252/174.14; 252/174.21; 252/174.24; 252/174.25; 252/DIG. 1; 264/117

[58] Field of Search ..... 252/89.1, 174.13, 252/174.21, DIG. 1, 135, 140, 174, 174.14, 174.25; 264/112, 113, 117; 427/180, 215, 220, 222

[56] References Cited

U.S. PATENT DOCUMENTS

| | | | |
|---|---|---|---|
| 3,944,500 | 3/1976 | Gancy et al. | 252/182 |
| 3,989,635 | 11/1976 | Toyoda et al. | 252/135 |
| 4,059,538 | 11/1977 | Green et al. | 252/95 |
| 4,427,417 | 1/1984 | Porasik | 23/313 R |
| 4,427,567 | 1/1984 | Benz | 252/116 |
| 4,663,194 | 5/1987 | Wixon | 427/214 |
| 4,666,738 | 5/1987 | Wixon | 427/214 |
| 5,024,782 | 6/1991 | Finn et al. | 252/174.13 |
| 5,133,924 | 7/1992 | Appel et al. | 264/342 R |
| 5,149,455 | 9/1992 | Jacobs et al. | 252/174.13 |
| 5,160,657 | 11/1992 | Bortolotti et al. | 252/174.14 |
| 5,164,108 | 11/1992 | Appel et al. | 252/174 |
| 5,178,798 | 1/1993 | Jolicoeur | 252/553 |

FOREIGN PATENT DOCUMENTS

| | | |
|---|---|---|
| 0179264 | 4/1986 | European Pat. Off. . |
| 0220024 | 4/1987 | European Pat. Off. . |
| 0340966 | 11/1989 | European Pat. Off. . |
| 0367339 | 5/1990 | European Pat. Off. . |
| 0388705 | 9/1990 | European Pat. Off. . |
| 0403084 | 12/1990 | European Pat. Off. . |
| 0420317 | 4/1991 | European Pat. Off. . |
| 0425277 | 5/1991 | European Pat. Off. . |
| 60-21200 | 5/1985 | Japan . |
| 61-89300 | 5/1986 | Japan . |
| 62-263299 | 11/1987 | Japan . |

OTHER PUBLICATIONS

Derwent Abstract of JPA 61–069897, 10 Apr. 1986.

*Primary Examiner*—Margaret Einsmann

*Attorney, Agent, or Firm*—Sughrue, Mion, Zinn, Macpeak & Seas

[57] ABSTRACT

A process for producing nonionic detergent granules having a bulk density of from 0.6 to 1.2 g/ml is disclosed, which comprises the following steps (1) to (3):

(1) mixing a detergent material comprising a nonionic surfactant;

(2) granulating a mixture obtained in said step (1) by agitating in an agitating mixer provided at the center position thereof with a rotation shaft having an agitation impeller with a clearance between the agitation impeller and an inner wall of the mixer, wherein the agitation impeller agitates the mixture to form an adhesion layer of said mixture on said inner wall of said mixer so as to increase a bulk density of granules of the mixture; and (3) mixing the granules obtained in said step (2) with fine particles to thereby coat the surface of the granules with the fine particles. The nonionic detergent granules containing a nonionic surfactant in a high content and having high bulk density and excellent powder fluidity and non-caking property can be produced in the process of the present invention with less suffering from restriction in the composition.

19 Claims, No Drawings

PROCESS FOR PRODUCING NONIONIC DETERGENT GRANULES

This is a continuation of application Ser. No. 07/878,452 filed May 5, 1992, now abandoned.

FIELD OF THE INVENTION

The present invention relates to a process for producing nonionic detergent granules comprising a nonionic surfactant. More particularly, the present invention relates to a process for producing nonionic detergent granules of high bulk density and excellent powder fluidity and noncaking property with less compositional restrictions.

BACKGROUND OF THE INVENTION

A process has been proposed for producing a granular detergent composition containing a nonionic surfactant which comprises mixing the nonionic surfactant with a detergent slurry and spray-drying the resulting mixture. This process, however, not only requires great expense for facilities but also uses great amounts of energy. Further, it has a possibility of causing thermal decomposition of the nonionic surfactant during the drying step, which entails problems such as generation of pollutants, reduction of the content of the nonionic surfactant, changes in the properties of the active agent and the like. In order to work out such problems, it is necessary to limit types and contents of nonionic surfactant as disclosed, for example, in JP-A-61-85499 (corresponding to U.S. Pat. No. 4,652,391) or to further blend a charge-transfer agent as disclosed, for example, in JP-A- 56-22394 (corresponding to U.S. Pat. No. 4,298,491). The term "JP-A" as used herein means an "unexamined published Japanese patent application".

JP-B-60-21200 (corresponding to DE 2,707,280) proposes a production process in which builder base beads are prepared by spray-drying and a nonionic surfactant is supported on the base beads. The term "JP-B" as used herein means an "examined Japanese patent publication". However, since this process requires an anhydrous phosphate builder salt as a base material, application thereof is restricted only to the production of phosphorous-containing detergents, so that phosphorous-free detergents could not be produced in the process. Further, it requires complicated handling for the preparation of base beads having porous surfaces and internal skeleton structures.

JP-A-61-21997 (corresponding to U.S. Pat. No. 4,427,417) discloses a process for the continuous production of a granular detergent free from caking during a prolonged period of storage which comprises hydrating and swelling a washing active salt using an agglomerater or the like, stirring the resulting swelled salt in a closed vessel, impregnating thereto a nonionic surfactant, an anionic surfactant and the like and then drying the resulting mixture. This process, however, requires a drying step after the granulation because the surfactant is impregnated into the hydration-swelled granular agglomerates of the washing active salt, thus it is too complicated. Further, since an amount of the nonionic surfactant which can be incorporated in the granular detergent depends upon the characteristics of the granular agglomerate, a granular agglomerate of high oil absorbing property should be prepared to increase the amount of the nonionic surfactant. However, when a granular agglomerate of high oil absorbing property is to be prepared, an amount of a non-hydrating washing active salt would be increased, so that an undesirable result is caused. Thus, compositions of granular detergents which can be produced in this process narrowly restricted. Furthermore, this process requires complicated operations (e.g., hydration and drying conditions) for the detergent production.

JP-A-3-26795 (corresponding to U.S. Pat. No. 5,024,782) discloses a process for producing a granular detergent having excellent fluidity, solubility and dispersibility which comprises forming zeolite agglomerates from a zeolite and a filler with using a water-containing binder in an agglomerate forming apparatus, further forming detergent agglomerates from the zeolite agglomerates and a detergent composition containing a surfactant, and then drying the resulting detergent agglomerates. This process, however, have disadvantages in that it requires complicated handling for the detergent production because at least five operation steps are necessary to obtain the detergent agglomerate, and that the zeolite agglomerate must be formed, thus the granular is apt to encounter a narrow compositional restriction.

JP-A-62-263299 discloses a process for the production of a granular detergent composition which comprises forming a solid detergent by uniformly kneading a nonionic surfactant and a builder and then crushing the solid detergent.

However, a granular detergent having good fluidizability is hardly obtained by this process, and a large amount of undesirable fine powders is co-produced in this process. Further, a zeolite and a light sodium carbonate should be employed in the granular detergent in an amount of 50 to 80% by weight in total, thus the detergent suffers from the restrictions of the composition.

JP-A-61-89300 discloses a process for producing nonionic surfactant-containing granules which comprises mixing a water-soluble powder and a powdery silica, spraying a nonionic surfactant onto the mixture, then adding thereto a zeolite or sodium carbonate powder. However, in this process, the granules are prepared by rolling and granulating using a drum type granulator of which granulation is effected with a rotating drum, a nonionic surfactant-containing granules of high bulk density cannot be obtained.

SUMMARY OF THE INVENTION

In view of the above, it is therefore an object of the present invention to provide a process for producing nonionic detergent granules containing a nonionic surfactant as the main washing base material, which have a high bulk density and excellent powder fluidity and non-caking property.

Another object of the present invention is to provide a process for producing nonionic detergent granules with convenient handling.

Still another object of the present invention is to provide a process for producing nonionic detergent granules wherein the composition of the detergent can widely be selected from various components and with less suffering from the restrictions.

A further object of the present invention is to provide a continuous process for producing nonionic detergent granules of high quality.

The inventors of the present invention have conducted intensive studies and, as a result, found a process for producing nonionic detergent granules which comprises mixing and granulating a detergent material, and subsequently mixing the resulting granules with fine particles to thereby coat the surface of the granules with the fine particles, thus the present invention has been accomplished.

Particularly, in accordance with the present invention, there is provided a process for producing nonionic detergent granules having a bulk density of from 0.6 to 1.2 g/ml which comprises the following steps (1) to (3):

(1) mixing a detergent material comprising a nonionic surfactant;

(2) granulating the mixture obtained in the step (1) by agitating in an agitating mixer provided at the center position thereof with a rotation shaft having an agitation impeller with a clearance between the agitation impeller and the inner wall of the mixer, wherein the agitation impeller agitates the mixture to form an adhesion layer of the mixture on the inner wall of the mixer so as to increase a bulk density of granules of the mixture; and (3) mixing the granules obtained in the step (2) with fine particles to thereby coat the surface of the granules with the fine particles. Other objects and advantages will be made apparent as the description progress.

DETAILED DESCRIPTION OF THE INVENTION

The detergent material to be used in the process of the present invention may be selected from the following (a) to (d):

(a) a detergent material comprising from 75 to 95 parts by weight of a builder and from 5 to 25 parts by weight of a nonionic surfactant;

(b) a detergent material comprising from 20 to 89 parts by weight of a builder, from 1 to 20 parts by weight of a porous oil absorbent carrier and from 10 to 60 parts by weight of a nonionic surfactant;

(c) a detergent material comprising from 75 to 95 parts by weight of a mixture of a builder and a spray-dried particulate wherein a weight ratio of the builder to the spray-dried particulate is from 5:95 to 95:5, and from 5 to 25 parts by weight of a nonionic surfactant; and (d) a detergent material comprising from 20 to 89 parts by weight of a mixture of a builder and a spray-dried particulate wherein a weight ratio of the builder to the spray-dried particulate is from 5:95 to 95:5, from 1 to 20 parts by weight of a porous oil absorbent carrier, and from 10 to 60 parts by weight of a nonionic surfactant;

wherein the builder is an organic or inorganic powder builder, the spray-dried particulate is obtained by spray-drying a slurry comprising an organic or inorganic builder, and the porous oil absorbent carrier has a pore volume of from 100 to 600 $cm^3$/100 g measured in the mercury porosimeter method, a specific surface area of from 20 to 700 $m^2$/g measured in the BET method and an oil absorption of 100 ml/100 g or more according to JIS K 5101.

Specifically, the oil absorption can be determined by measuring the quantity of boiled linseed oil by the following operation:

(a) Place 1 to 5 g of sample in the center of the glass plate, drop gradually each 4 to 5 drops per ounce of boiled linseed oil from the burette onto the center of the sample, and sufficiently knead the sample with the pallet knife each time;

(b) Repeat the dropping and kneading procedure until the sample becomes a hard putty-like lump. Knead together after each drop, and note the point when one more drop creates a sample capable of being wound around the pallet knife in a spiral as an end point. However, where it cannot be wound spirally, take the point just before it quickly becomes soft with one more drop of boiled linseed oil as the end point.

(c) Control the operation of (a) and (b) so that the time required for reaching the end point becomes 7 to 15 min.

(d) Read the dropped quantity of boiled linseed oil in the burette when the end point is reached.

In the practice of the process of the present invention, a method for feeding the detergent material into a mixer is not particularly limited.

When the step (1), i.e., the step for mixing the detergent material, is carried out in batchwise operation, any of the following methods (i) to (v) may be used.

(i) At least one component selected from an organic or inorganic powder builder, a spray-dried particulate and a porous oil absorbent carrier is/are first fed into a mixer and then a nonionic surfactant is fed into the mixer.

(ii) At least two components selected from an organic or inorganic powder builder, a spray-dried particulate and a porous oil absorbent carrier are previously mixed and fed into a mixer, and then a nonionic surfactant is fed into the mixer.

(iii) At least one component selected from an organic or inorganic powder builder, a spray-dried particulate and a porous oil absorbent carrier is/are gradually fed into a mixer simultaneously with a nonionic surfactant.

(iv) A portion of at least one component selected from an organic or inorganic powder builder, a spray-dried particulate and a porous oil absorbent carrier is/are first fed into a mixer and then the rest of the organic or inorganic powder builder, the spray-dried particulate, the porous oil absorbent carrier and a nonionic surfactant are gradually fed into the mixer simultaneously.

(v) A nonionic surfactant and at least one component selected from an organic or inorganic powder builder, a spray-dried particulate and a porous oil absorbent carrier are previously mixed and fed into a mixer.

Among them, the manner in which at least one component selected from an organic or inorganic powder builder, a spray-dried particulates and a porous oil absorbent carrier is/are first fed into a mixer and then a nonionic surfactant is fed into the mixer is particularly preferred.

When the step (1) is carried out in continuous operation, any of the following methods (vi) to (viii) may be used.

(vi) Each of components of the detergent material is independently and continuously fed into a mixer.

(vii) Powder components of the detergent material are first mixed and the resulting mixture and a nonionic surfactant are independently and continuously fed into a mixer.

(viii) At least two powder components of the detergent material are first mixed, and the resulting mixture, powder component(s) other than those previously mixed and a nonionic surfactant are independently and continuously fed into a mixer.

Of these, methods (vii) and (viii) are useful when powder materials to be used are poor in physical properties such as fluidity, non-caking property and the like.

As an embodiment of the process of the present invention in which detergent materials are continuously granulated, a nonionic surfactant and all the other powder materials may be mixed in advance in a batchwise manner, followed by continuous feeding of the mixture into the granulation step.

Further, in either batchwise operation and continuous operation, it is preferred that the nonionic surfactant is fed into the mixer in spraying manner.

The step (1) of the process of the present invention, i.e., the step for mixing a detergent material comprising a nonionic surfactant, can be carried out either in batchwise operation or in continuous operation.

The following describes preferred apparatuses to be used in the step (1) of the process of the present invention.

(A) When the step (1) is carried out in batchwise operation, the following means (A-1) to (A-4) can preferably be used as apparatuses for use in batchwise operation.

(A-1) A mixer having a mixing vessel provided with an agitation shaft inside the vessel in which mixing of materials is effected by an agitation impeller attached to the agitation shaft. Examples of this type of mixer include Henschel Mixer (tradename, manufactured by Mitsui Miike Machinery Co., Ltd.), High Speed Mixer (tradename, manufactured by Fukae Powtec Corp.), Vertical Granulator (tradename, manufactured by Powrex) and the like. Among them, a mixer having a horizontal mixing cylinder provided with an agitation shaft inside the cylinder in which mixing of materials is effected by an agitation impeller attached to the agitation shaft, such as Lödige Mixer (tradename, manufactured by Matsuzaka Giken Co., Ltd.), PLOUGH SHARE Mixer (tradename, manufactured by PACIFIC MACHINERY & ENGINEERING CO., LTD.) or the like.

(A-2) A mixer having a V-shaped mixing vessel in which mixing of materials is effected by rotating the vessel, such as V-type Mixer (tradename, manufactured by Fuji Paudal Co., Ltd.) or the like.

(A-3) A mixer having a fixed semicylindrical mixing vessel in which mixing of materials is effected by rotating spiral ribbon impeller in the fixed vessel, such as Ribbon Mixer (tradename, manufactured by Fuji Paudal Co., Ltd.) or the like.

(A-4) A mixer having a conical mixing vessel provided with a screw inside the vessel in which mixing of materials is effected by the revolution of a rotating screw around an axis parallel to the vessel wall. Examples of this type of mixer include Nauta Mixer (tradename, manufactured by Hosokawa Micron Corp.), SV Mixer (tradename, manufactured by Shinko Panteck Co., Ltd.) and the like.

(B) When the step (1) is carried out in continuous operation, the following means (B-1) to (B-3) can preferably be used as apparatuses for use in continuous operation.

(B-1) A continuous mixer having a vertical cylinder provided with an inlet for powder charging and a main shaft provided with a mixing impeller in which the main shaft is supported by an upper shaft bearing and the discharging side is not supported, such as Flexo Mix (tradename, manufactured by POWREX CORP.) or the like.

(B-2) A continuous mixer having a disk provided with agitation pins in which mixing of materials is effected by charging the materials on the disk and rotating the disk at a high speed to generate shearing force. Examples of this type of mixer includes Flow Jet Mixer (tradename, manufactured by Funken Powtechs, Inc.), Spiral Pin Mixer (tradename, manufactured by PACIFIC MACHINERY & ENGINEERING CO., LTD.) and the like.

(B-3) A continuous mixer having a mixing vessel provided with an agitation shaft inside the vessel in which mixing of materials is effected by an impeller attached to the agitation shaft. Examples of this type of mixer include Continuous Henschel Mixer (tradename, manufactured by Mitsui Miike Machinery Co., Ltd.). High Speed Mixer (tradename, manufactured by Fukae Powtec Corp.), Vertical Granulator (tradename, manufactured by POWREX) and the like may also be useful as continuous mixers of this type. Preferred examples include a mixer having a horizontal mixing cylinder provided with an agitation shaft inside the cylinder in which mixing of materials is effected by an impeller attached to the agitation shaft, such as Lödige Mixer (tradename, manufactured by Matsuzaka Giken Co., Ltd.), PLOUGH SHARE Mixer (tradename, manufactured by PACIFIC MACHINERY & ENGINEERING CO., LTD.) or the like.

An agitating mixer to be used in the step (2) of the present invention must be provided at the center thereof with a rotation shaft having an agitation impeller with a clearance between the agitation impeller and the inner wall of the mixer. The average clearance between the agitation impeller and the inner wall of the mixer is preferably adjusted to from 1 to 30 mm. Examples of the mixer of this type include Henschel Mixer (Mitsui Miike Machinery Co., Ltd.), High Speed Mixer (Fukae Powtec Corp.), Vertical Granulator (POWREX CORP.) and the like. Among them, an agitating mixer having a horizontal mixing cylinder provided with an agitation shaft at the center of the cylinder in which mixing of materials is effected by an impeller attached to the agitation shaft, such as Lödige Mixer (Matsuzaka Giken Co., Ltd.), PLOUGH SHARE Mixer (PACIFIC MACHINERY & ENGINEERING Co., Ltd.) or the like.

Although an apparatus to be used in the step (3) is not particularly limited and conventional mixers can be used therefor, it is preferred to use one of the mixers mentioned for the steps (1) and (2). The mixer mentioned for the step (2) is more preferably used for the step (3), but the clearance between the agitation impeller and the inner wall of the mixer need not be adjusted to from 1 to 30 mm in the step (3).

The steps (2) and (3) can be carried out in batchwise operation with using the mixers mentioned above. By selecting from among the mixers mentioned above a mixer of the type that continuous feeding and discharging of a material can be conducted, the steps (2) and (3) can be carried out in continuous operation.

When the process of the present invention is carried out in batchwise operation, the steps (1) and (2) or the steps (1), (2) and (3) can be carried out in a single apparatus by using the agitation mixer mentioned for the step (2). In either cases where the steps (1) and (2) or (1), (2) and (3) are carried out in a single mixer, granulation of the detergent material partially proceeds simultaneously with mixing of the detergent material and, by conducting further agitation, granulation of the mixed detergent material can be completed. When the steps (1), (2) and (3) are carried out in a single mixer, the agitation mixer having a horizontal mixing cylinder provided with an agitation shaft at the center of the cylinder is particularly preferred.

When the process of the present invention is carried out in continuous operation, the steps (1) and (2) can be carried out simultaneously in a single apparatus by using the agitation mixer mentioned for the step (2). Further, steps (1) and (2), steps (2) and (3), or steps (1), (2) and (3) may be carried out continuously using a single agitation mixer when the agitating mixer having a horizontal mixing cylinder provided with an agitation shaft at the center of the cylinder is further provided with a means for dividing the horizontal mixing cylinder at right angles to the agitation shaft (e.g., a partition plate set inside the horizontal mixing cylinder at right angles to the agitation shaft).

The agitation mixers having the aforementioned structures are used in the process of the present invention for the following reasons.

When a mixture of a detergent material comprising a nonionic surfactant having weak bonding strength is subjected to granulation in a condition according to the present invention, it is possible to form an adhesion layer on the inner wall of the agitation mixer by rotation of the agitation impeller, thereby high density granules can be produced without causing over power of the agitation mixer (over load of the agitating mixer), decrease in granulation efficiency (formation of coarse granules) and the like.

Such phenomena are believed to be caused in the following way.

In the adhesion layer made of the mixture of the detergent material, a compression degree of a part at the side of the agitation impeller is increased by contact with the agitation impeller, while a part closer to the inner wall of the agitating mixer has a lower compression degree. Thus the adhesion layer has elasticity of a certain extent. Due to elasticity of the adhesion layer, the detergent material is taken between the adhesion layer and the agitation impeller as the impeller rotates and an over load of agitating mixer is not caused. The detergent material taken between the adhesion layer and the impeller is compressed and undergoes a rolling action by rotation of the impeller, whereby spheroidization of the detergent material proceeds and the spheroidized detergent materials are peeled off from the adhesion layer. The spheroidized detergent materials thus peeled off undergoes a rolling action in the mixing area of the agitating mixer and spheroidization thereof further proceeds.

Namely, it is considered that an appropriate compression and rolling granulation of the detergent material is effected by compression and rolling on the adhesion layer and rolling in the mixing area of the agitating mixer.

In order to attain such a compression and rolling granulation, it is important that the agitation impeller must be provided so as to form an clearance between the agitation impeller and the inner wall of agitating mixer. The average clearance of the agitation impeller and the inner wall of the agitating mixer is from 1 to 30 mm, preferably from 3 to 10 mm. When the average clearance is less than 1 mm, the compression degree of the adhesion layer tends to be too high, whereby the agitating mixer tends to becomes over loaded. On the other hand, when the average clearance is more than 30 mm, efficiency of compression of the adhesion layer tends to lower, whereby a granule size distribution will become broad. Further, the period of time required for granulation becomes longer, thus production efficiency lowers.

Conditions suitable for attaining such a granulation are follows.

(i) Froude number

A Froude number (Fr) defined by the following equation is preferably from 1 to 4, more preferably from 1.2 to 3.

$$Fr=V/(R\times g)^{0.5}$$

where V is a rotation speed of the tip of the agitation impeller (m/s); R is a radius of gyration of the agitation impeller (m); g is the acceleration of gravity.

When the Froude number is less than 1, compression of the detergent material will not be promoted, whereas when it is more than 4, the adhesion layer will not be formed sufficiently, whereby the resulting granule size distribution tends to be broad.

(ii) Granulation period

A granulation period in batchwise operation or an average retention period in continuous operation required for attaining a desired granulation is preferably from 0.5 to 20 minutes, more preferably from 3 to 10 minutes.

When a granulation period is less than 0.5 minute, granulation period is too short, so that granulation control for attaining a desired average granule size and bulk density is difficult, whereas it is more than 20 minutes, granulation period is too long, whereby the production efficiency lowers.

(3) Feeding amount of the detergent material

Feeding amount of the detergent material is preferably 70% by volume or less, more preferably from 15 to 40% by volume, of the total volume of the agitating mixer. When it is more than 70% by volume, mixing efficiency of the detergent material in the agitation mixer lowers, whereby the granulation efficiency lowers.

(4) Temperature

The agitating mixer to be used in the present invention is preferably further provided with a jacket. The temperature of a medium to be circulated in the jacket is preferably from 5 to 40° C, more preferably from 10 to 20° C. By circulating the medium of the temperature range, compression and rolling granulation of the detergent material on the adhesion layer are promoted and the period for attaining a desired granulation can be shortened, whereby the production efficiency is increased and a granular size distribution becomes narrow. The temperature of the content in the agitating mixer need not be controlled particularly, and, of the detergent material, powder components can be supplied at room temperature and the nonionic surfactant can be supplied at a temperature at which the nonionic surfactant is melting. In general, the temperature of the content in the agitating mixer ranges from 30° to 60° C. with a balance of the temperature of the feeding detergent material and the heat by agitation.

By employing the conditions above, compression and rolling granulation proceed and the granules of a high bulk density can be produced.

In the practice of the present invention, the inner wall of the agitating mixer may be any of the upper, side or bottom walls inside the agitating mixer.

In the aforementioned detergent materials (c) and (d), the spray-dried particulate prepared by spray-drying a slurry using a spray dryer is used in order to (1) control bulk density of the nonionic detergent granules and (2) improve oil absorption of a builder.

The spray-dried particulate can be prepared by drying an aqueous slurry of a builder with a conventional spray-drying method.

The aqueous slurry contains water in an amount of from 30 to 80% by weight, more preferably from 35 to 60% by weight, based on the slurry. If necessary, when such spray-dried particulates are prepared, a surfactant selected from anionic, cat ionic and nonionic surfactant and other additives may be added in an amount of 40% by weight or less and 5% by weight or less, respectively, based on the spray-dried particulate.

Examples of the other additives include fluorescent dyes, anti-oxidants and the like.

Examples of organic or inorganic builders which can be used in the spray-dried particulate will be described later. Among them, citrates and polyacrylic, polyethylene glucose are more preferred as the organic builder to be used in the spray-dried particulate, and sodium tripolyphosphate, sodium carbonate, aluminosilicates and silicate compounds having an ion-exchanging ability of 100 or more (in terms of $CaCO_3$ mg/g) are more preferred as the inorganic builder to be used for the spray-dried particulate. The average particle size of the spray-dried particulate preferably ranges from 100 to 600 μm, more preferably from 150 to 400 μm. The average particle size of the spray-dried particulate can be measured by subjecting the spray-dried particulates to screening using the standard sieves according to JIS Z 8801 with a vibration for 5 minutes and measuring the weight ratios of the particulates passed each size of the sieves.

In the detergent materials (c) and (d) to be used in the present invention, an organic or inorganic powder builder and the spray-dried particulate may be used in a weight ratio of from 5:95 to 95:5, preferably from 20:80 to 90:10, more preferably from 60:40 to 90:10.

An average particle size of the builder to be used in the process of the present invention preferably ranges to from 0.1 to 800 μm. When the average particle size of the builder is from 100 μm or more, it can be measured by a similar manner as the particle size of the spray-dried particulate, whereas when the average particle size of the builder is 100 μm or less, it can be measured by a method using light-scattering such as a method using a particle analyzer (manufactured by Horiba Ltd., for example).

Examples of the builders to be used in the process for producing the nonionic detergent granules of the present invention include the compounds mentioned below. As the builders to be used in the present invention, the following compounds are in the form of powders. Further, among those compounds, compounds capable of hydration may be used with mixing with water so as to form a hydrated salt.

Specific examples of inorganic builders include alkaline salts such as sodium carbonate, potassium carbonate, sodium bicarbonate, sodium sulfite, sodium sesquicarbonate, sodium silicate and silicate compounds having an ion-exchanging ability of 100 (in terms of $CaCO_3$ mg/g) or more, preferably from 100 to 500 (in terms of $CaCO_3$ mg/g) (e.g., sodium silica-based and potassium silica-based silicate compounds); neutral salts such as sodium sulfate; phosphoric acid salts (preferably alkali metal salt) such as orthophosphates, pyrophosphates, tripolyphosphates, metaphosphates, hexametaphosphates and phytates; as well as the following aluminosilicates (No. 1) to (No. 3).

(No. 1) Crystalline aluminosilicates represented by the following formula:

$$x'(M_2O).Al_2O_3.y'(SiO_2).w'(H_2O)$$

wherein M is an alkali metal atom such as sodium and potassium; and x', y' and w' are mol numbers of corresponding components generally in the following range:

$0.7 \leqq x' \leqq 1.5$ and $0.8 \leqq y' \leqq 6$, while w' is an arbitrary constant.

Among them, a compound represented by the following formula is more preferred:

$$Na_2O.Al_2O_3.nSiO_2.wH_2O$$

wherein n is 1.8 to 3.0 and w is 1 to 6.

(No. 2) Amorphous aluminosilicates represented by the following general formula:

$$x(M_{2l\ O)}.Al_2O_3.y(SiO_2).w(H_2O)$$

wherein M is sodium and/or potassium atom; and x, y and w are mol numbers of corresponding components in the following range:

$0.7 \leqq x \leqq 1.2$ and $1.6 \leqq y \leqq 2.8$, while w is an arbitrary integer including 0.

(No. 3) Amorphous aluminosilicates represented by the following formula:

$$x(M_2O).Al_2O_3.y(SiO_2),.z(P_2O_5).w(H_2O)$$

wherein M is sodium or potassium atom; and x, y, z and w are mol numbers of corresponding components in the following range:

$0.20 \leqq x \leqq 1.10$, $0.20 \leqq y \leqq 4.00$ and $0.001 \leqq z \leqq 0.80$, while w is an arbitrary integer including 0.

Particularly preferred compounds among these inorganic builders include sodium tripolyphosphate, sodium carbonate, aluminosilicates and silicate compounds having an ion-exchanging ability of 100 (in terms of $CaCO_3$ mg/g) or more.

Specific examples of organic builders include following compounds.

(1) Phosphonic acid salts such as of ethane-1,1-diphosphonic acid, ethane-1,2-triphosphonic acid, ethane-1-hydroxy- 1,1-diphosphonic acid and derivatives thereof, ethanehydroxy-1,1,2-triphosphonic acid, ethane-1,2-dicarboxy- 1,2-diphosphonic acid, methanehydroxyphosphonic acid and the like.

(2) Phosphonocarboxylic acid salts such as of 2-phosphonobutane- 1,2-dicarboxylic acid, 1-phosphonobutane- 2,3,4-tricarboxylic acid, a-methylphosphonosuccinic acid and the like.

(3) Amino acid salts such as of aspartic acid, glutamic acid and the like.

(4) Aminopolyacetic acid salts such as of nitrilotriacetic acid, ethylenediaminetetraacetic acid, diethylenediaminehexaacetic acid and the like.

(5) High polymer electrolytes such as polyacrylic acid, polyaconitic acid, polyitaconic acid, polycitraconic acid, polyfumaric acid, polymaleic acid, polymesaconic acid, poly-α-hydroxyacrylic acid, polyvinyl phosphonic acid, sulfonated polymaleic acid, a maleic anhydride-diisobutylene copolymer, a maleic anhydride-styrene copolymer, a maleic anhydride-methylvinyl ether copolymer, a maleic anhydrideethylene copolymer, a maleic anhydride-ethylene crosslink copolymer, a maleic anhydride-vinyl acetate copolymer, a maleic anhydride-acrylonitrile copolymer, a maleic anhydride-acrylic acid ester copolymer, a maleic anhydride-butadiene copolymer, a maleic anhydride-isoprene copolymer, a poly-β-ketocarboxylic acid derived from maleic anhydride and carbon monoxide, an itaconic acid-ethylene copolymer, an itaconic acid-aconitic acid copolymer, an itaconic acid-maleic acid copolymer, an itaconic acid-acrylic acid copolymer, a malonic acid-methylene copolymer, an itaconic acid-fumaric acid copolymer, an ethylene glycol-ethyleneterephthalate copolymer, a vinyl pyrrolidone-vinyl acetate copolymer, a 1-butene- 2,3,4-tricarboxylic acid-itaconic acid-acrylic acid copolymer, a polyester polyaldehyde carboxylic acid having a quaternary ammonium group, cis-isomer of epoxysuccinic acid, poly [N,N-bis(carboxymethyl)acrylamide], poly(oxycarboxylic acid), succinic, maleic or terephthalic acid ester of starch, phosphoric acid ester of starch, dicarboxy starch, dicarboxymethyl starch, carboxymethyl cellulose, succinic acid esters and the like.

(6) Non-dissociation high polymers such as polyethylene glycol, polyvinyl alcohol, polyvinyl pyrrolidone, carboxymethyl cellulose, cold water-soluble urethanated polyvinyl alcohol and the like.

(7) Organic acid salts such as carboxymethylated products of diglycolic acid, oxydisuccinic acid, carboxymethyloxysuccinic acid, cyclopentane-1,2,3,4-tetracarboxylic acid, tetrahydrofuran-1,2,3,4-tetracarboxylic acid, tetrahydrofuran- 2,2,5,5-tetracarboxylic acid, citric acid, lactic acid, tartaric acid, sucrose, lactose, raffinose and the like, carboxymethylated pentaerythritol, carboxymethylated gluconic acid, condensation products of a polyhydric alcohol or a sugar with maleic anhydride or succinic anhydride, condensation products of oxycarboxylic acid with maleic anhydride or succinic anhydride, benzene polycarboxylic acids such as mellitic acid, ethane-1,1,2,2-tetracarboxylic acid, ethene-1,1,2,2-tetracarboxylic acid, butane-1,2,3,4-tetracarboxylic acid, propane-1,2,3-tricarboxylic acid, butane- 1,4-dicarboxylic acid, oxalic acid, sulfosuccinic acid, decane-1, 10-dicarboxylic acid, sulfotricarbaryl acid, sulfoitaconic acid, malic acid, oxydisuccinic acid, gluconic acid, CMOS, builder M and the like.

Preferred compounds among these organic builders are citrates, polyacrylates and polyethylene glycols, more preferably trisodium citrate, sodium polyacrylate and polyethylene glycol having a molecular weight of from 4,000 to 20,000.

A porous oil absorbent carrier to be used in the present invention may have a pore volume of from 100 to 600 $cm^3$/100 g measured in the mercury porosimeter method, a specific surface area of from 20 to 700 $m^2$/g measured in the BET method and an oil absorption of 100 ml/100 g or more measured in the procedure according to JIS K 5101.

The oil absorption can be measured by measuring the amount of boiled linseed oil absorbed in the porous oil absorbent carrier according to the method specified in JIS K 5101.

An average particle size of the porous oil absorbent carrier is preferably from 0.5 to 500 μm as an agglomerate and more preferably from 1 to 200 μm. The average particle size of the porous oil absorbent carrier can be measured by a similar method as the average particle size of the builder.

Specific examples of the porous oil absorbing carrier include the following compounds.

(1) Amorphous silica derivatives

Preferred examples are synthetic derivatives having silica as the main structure and containing a secondary component such as $Al_2O_3$, $M_2O$ (M means an alkali metal), MeO (Me means an alkaline earth metal) or the like. In this instance, not only a two-element composition but also three-element, four-element and the like compositions may also be used preferably. The following three types of amorphous silica derivatives are preferred examples.

(1-i) Derivatives containing silica as the main component such as Tokusil NR, PR and AL-1, tradenames, manufactured by Tokuyama Soda Co., Ltd.; Nipsil NS, Nipsil NA-R and Nipsil ES, tradenames, manufactured by Nippon Silica Industrial Co., Ltd.; SIPERNAT 22, SIPERNAT 50 and DUROSIL, tradenames, manufactured by Degussa; ZEOSIL 45 and TIXOSIL 38, tradenames, manufactured by KOFRAN CHEMICAL Co., Ltd.; and Carplex 100, tradename, manufactured by Shionogi & Co., Ltd.

(1-ii) Derivatives containing calcium silicate as the main component such as HUBERSORB® 600 manufactured by J. M. Huber Corporation.

(1-iii) Derivatives containing aluminosilicate as the main component such as Aluminum Silicate P820, tradename, manufactured by Degussa and TIXOLEX 25, tradename, manufactured by KOFRAN CHEMICAL; Co., Ltd.

Compounds represented by the following formulae (a) and (b) are particularly preferred. Such compounds are possessed of ion-exchanging ability.

$$x(M_2O).Al_2O_3.y(SiO_2).w(H_2O) \quad (a)$$

wherein M is an alkali metal such as sodium and potassium and x, y and w are mol numbers of corresponding components in the range of $0.2 \leqq x \leqq 2.0$ and $0.5 \leqq y \leqq 10.0$ while w is an arbitrary integer including 0.

$$x(MeO).y(M_2O).Al_2O_3.z(SiO_2).w(H_2O) \quad (b)$$

wherein Me is an alkaline earth metal such as calcium and magnesium, M is an alkali metal such as sodium and potassium, and x, y, z and w are mol numbers of corresponding components in the following range:

$0.001 \leqq x \leqq 0.1$, $0.2 \leqq y \leqq 2.0$, and $0.5 \leqq z \leqq 10.0$, while w is an arbitrary integer including 0.

(2) Calcium silicate

Specific examples include FLORITE® (tradename, manufactured by Tokuyama Soda Co., Ltd.) and the like.

(3) Calcium carbonate

Specific examples include Callite KT (tradename, manufactured by Shiraishi Kogyo Co., Ltd.) and the like.

(4) Magnesium carbonate

Specific examples include Magnesium Carbonate TT (tradename, manufactured by Tokuyama Soda Co., Ltd.) and the like.

(5) Pearlite

Specific examples include Pearlite 4159 (tradename, manufactured by Dicalite Orient Co., Ltd.) and the like.

Among these porous oil absorbent carriers, amorphous silica derivatives may be preferable, particularly amorphous aluminosilicates.

The nonionic surfactant to be used in the present invention is not particularly limited but those being in a liquid or paste form at 40° C. and having an HLB of from 9.0 to 16.0 are preferred in view of dirt removal property, foaming property and foam-breaking property. The term "HLB" as used herein is defined, for example, in J. T. Dvies and E. K. Rideal, *Interfacial Phenomena,* Academic Press, New York, pp.371–383 (1963), and can be determined by the following equation:

$$HLB = 7 + \Sigma(\text{number of hydrophilic groups}) - Z(\text{number of hydrophobic groups})$$

The number of groups of each atomic group to be used in the calculation of HLB are as follows.

| Atomic group | Number of groups |
|---|---|
| Hydrophilic groups: | |
| ester (sorbitan ring) | 6.8 |
| ester (free) | 2.4 |
| —COOH | 2.1 |
| OH (free) | 1.3 |
| —O— | 0.5 |
| OH (sorbitan ring) | 0.5 |
| Lipophilic groups: | |
| $-\overset{\vert}{CH}-$ | 0.475 |
| $-CH_2-$ | 0.475 |
| $CH_3-$ | 0.475 |
| $=CH-$ | 0.475 |
| Derivative groups: | |
| $-(CH_2-CH_2-O)-$ | 0.33 |
| $-(CH_2-\underset{\underset{CH_3}{\vert}}{CH}-O)-$ | 0.15 |

Specific examples of nonionic surfactants to be used in the present invention include a polyoxyethylene alkyl ether, a polyoxyethylene alkylphenyl ether, a polyoxyethylene sorbitan fatty acid ester, a polyoxyethylene sorbitol fatty acid ester, a polyethylene glycol fatty acid ester, a polyoxyethylene polyoxypropylene alkyl ether, a polyoxyethylene castor oil, a polyoxyethylene hydrogenated castor oil, a polyoxyethylene alkylamine, a glycerol fatty acid ester, a higher fatty acid alkanolamide, an alkyl glycoside, an alkylamine oxide and the like.

Of these, it is preferable to use as the main nonionic surfactant a polyoxyethylene alkyl ether of a straight chain or branched-chain primary or secondary alcohol having from 10 to 20 carbon atoms, preferably from 10 to 15 carbon atoms, more preferably from 12 to 14 carbon atoms, with ethylene oxides in a mean added mol number of from 5 to 15, preferably from 6 to 12, more preferably from 6 to 10.

Although such polyoxyethylene alkyl ethers generally contain a large portion of alkyl ethers having low added mol numbers of ethylene oxide, it is preferable to use a type which contains 0 to 3 mol addition products in an amount of 35% by weight or less, preferably 25% by weight or less.

The amount of a nonionic surfactant to be blended in the detergent material (a) or (c) of the present invention may be in the range of from 5 to 25% by weight, preferably from 10 to 25% by weight, based on the detergent material. When nonionic detergent granules are produced using the detergent material (a) or (c), the amount of a nonionic surfactant of less than 5% by weight will bear no significant effect, whereas the amount larger than 25% by weight will reduce powder properties, especially fluidity of the resulting detergent granules.

The amount of a nonionic surfactant to be blended in the detergent material (b) or (d) of the present invention may be in the range of from 10 to 60% by weight, preferably from 15 to 50% by weight, based on the detergent material. When a nonionic detergent is produced using the detergent material (b) or (d), the amount of a nonionic surfactant to be blended can be increased by the use of a porous oil absorbent carrier, but even in that case, amounts of the nonionic surfactant exceeding 60% by weight will reduce powder properties, especially fluidity of the resulting detergent granules.

Among the detergent materials, the detergent martials (b) and (d) may advantageously used in the process of the present invention.

In the practice of the present invention, a binder may be added either at the time of mixing the detergent material or the time of granulating the mixture of the detergent material in order to promote granulation of the detergent material.

Examples of binders to be used at the time of mixing or granulating in the process of the present invention include solutions of water soluble polymer such as carboxymethyl cellulose, polyethylene glycol, polycarboxylates (e.g., sodium polyacrylate) and the like; nonionic compounds such as polyoxyethylene alkyl ethers, fatty acid monoethanolamides, fatty acid diethanolamides, polyethylene glycol and the like; and fatty acids, sodium silicate aqueous solution, water and the like. These binders may be blended in an amount of preferably from 0.1 to 10 parts by weight, more preferably from 0.5 to 5 parts by weight, based on 100 parts by weight of a mixture or a granulation product.

In the process of the present invention, the surface of granulation product obtained in the step (2) is coated with fine particles as a surface coating agent in order to improve fluidity and non-caking ability of the resulting detergent granules.

The surface coating agent is added after completion of the granulation step, because the coating agent is incorporated into granules when added at early or middle stage of the granulation step and therefore cannot contribute to the improvement of fluidity and non-caking property of the granules.

The term "after granulation" as used herein means a stage when granules are grown into a predetermined mean particle size within the range of from 250 to 1,000 μm.

According to the process of the present invention, for the purpose of improving fluidity and non-caking property of granules, the fine particles for coating the surface of granules may be blended in an amount of from 0.5 to 30 parts by weight, preferably from 1 to 25 parts by weight, based on 100 parts by weight of the granulation product obtained in the step (2). A mean primary particle size of the fine particles is preferably 10 μm or less. As the surface coating agent, aluminosilicates, especially those having a mean primary particle size of 10 μm or less may preferably be used, because such salts act as a calcium ion scavenger at the time of washing. Also useful as the surface coating agent include inorganic fine particles of silicate compounds such as silicon dioxide, bentonite, talc, clay, amorphous silica derivatives and the like, each of which has a mean primary particle size of 10 μm or less. Preferred and specific examples of the silicate compound such as aluminosilicates and amorphous silica derivatives include those mentioned above in relation to the inorganic builder and the porous oil absorbing carrier. Further, metal soap having a mean primary particle size of 10 μm or less can also be used as the surface coating agent. If the amount of the surface coating agent to be added to the granulation product is smaller than 0.5 part by weight, detergent granules of good fluidity are hardly obtained, whereas if the amount exceeds 30 parts by weight, fluidity of the resulting detergent granules is reduced and generation of dust is caused, which spoils the feel at use of the detergent granules.

The mean primary particle size of the fine particles can be measured by a method using light-scattering such as a method using a particle analyzer (manufactured by Horiba, Ltd., for example), or by the observation with a microscope.

According to the process of the present invention, the following various additive agents may be used during the step (1), (2) or (3) or after the step (3) of the process.

(1) Bleaching agents

Specific examples include sodium percarbonate, sodium perborate, sodium sulfate-hydrogen peroxide addition compounds and the like.

(2) Enzymes (which can exhibit their activities during washing)

Examples of enzymes applicable to the present invention in terms of its reactivity include hydrolases, hydrases, oxidoreductases, desmolases, transferases and isomerases. Particularly preferred are hydrolases such as proteases, esterases, carbohydrases and nucleases.

Specific examples of proteases include pepsin, trypsin, chymotrypsin, collagenase, keratinase, elastase, subtilicin, BPN, papain, bromelain, carboxypeptidases A and B, aminopeptidase and aspergillopeptidases A and B.

Specific examples of esterases include gastric lipase, pancreatic lipase, plant lipases, phospholipases, cholin esterases and phosphatases.

Specific examples of carbohydrases include cellulase, maltase, saccharase, amylase, pectinase, lysozyme, α-glycosidase and β-glycosidase.

(3) Blueing agents

Various types of blueing agents may also be blended when required. For example, compounds having the following structures (I) and (II) may be used preferably.

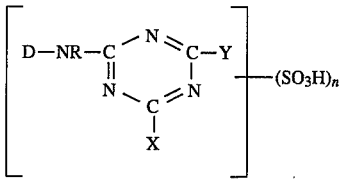

(I)

In this formula, D is a residue of a blue or purple monoazo, dis-azo or anthraquinone dye; X and Y are an aliphatic amino group which may be substituted by a hydroxyl group, an amino group, a sulfonic group, a carboxylic group or an alkoxyl group, and an aromatic or alicyclic amino group which may be substituted by a halogen atom, a hydroxyl group, a sulfonic group, a carboxylic group, a lower alkyl group or a lower alkoxyl group; R is a hydrogen atom or a lower alkyl group, provided that, when R is a hydrogen atom, (1) X and Y are not hydroxyl groups or alkanolamino groups at the same time and (2) one of X and Y is not hydroxyl group when the other is an alkanolamino group; and n is an integer of 2 or more.

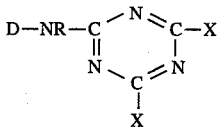

(II)

In this formula, D is a residue of a blue or purple azo or anthraquinone dye; and X and Y are the same or different alkanolamino residues or hydroxyl groups.

(4) Anti-caking agents

Specific examples include paratoluene sulfonates, xylene sulfonates, acetates, sulfosuccinates, talc, powder silica, clay, calcium silicates (for instance, Microcell, tradename, manufactured by Johns Manviii), magnesium oxide and the like.

(5) Antioxidants

Specific examples include tert-butyl-hydroxytoluene, 4,4'-butylidene-bis(6-tert-butyl-3-methylphenol), 2,2'-butylidene-bis(tert-butyl- 4-methylphenol), monostyrenated cresol, distyrenated cresol, mono-styrenated phenol, distyrenated phenol, 1,1'-bis(4-hydroxyphenyl)cyclohexane and the like.

(6) Fluorescent dyes

Specific examples include 4,4'-bis(2-sulfostyryl)-biphenyl salts, 4,4'-bis(4-chloro-3-sulfostyryl)-biphenyl salts, 2-(styrylphenyl)naphthothiazole derivatives, 4,4'-bis(triazole- 2-yl)stilbene derivatives and bis(triazinylamino)stilbene disulfonic acid derivatives. These compounds may be contained in the composition alone or as a mixture of two or more in an amount of from 0 to 1% by weight.

(7) Photo-activation bleaching agents

One or two of sulfonated aluminum phthalocyanine and sulfonated zinc phthalocyanine may be contained in the composition in an amount of from 0 to 0.2% by weight.

(8) Perfumes (9) Re-contamination preventing agents

Specific examples include polyethylene glycol, polyvinyl alcohol, polyvinyl pyrrolidone, carboxymethyl cellulose and the like. These compounds may be contained in the composition alone or as a mixture of two or more in an amount of from 0.1 to 5% by weight.

(10) Surface active agents

Specific examples include anionic surface active agents such as alkylbenzene sulfonates, alkyl or alkenyl ether sulfates, alkyl or alkenyl sulfates, α-olefin sulfonates, α-sulfo fatty acid salts or ester salts, alkyl or alkenyl ether carboxylates, soap and the like; ampholytic surface active agents such as carbobetaine, sulfobetaine and the like; and cationic surface active agents such as di-long chain quaternary ammonium salts and the like.

The process of the present invention makes it possible to produce detergent granules from various detergent materials without narrow compositional restrictions which have been encountered in the granulation method using hydration of washing salts or in attaining steady operation for the solidifying/crushing method for attaining steady operation.

The nonionic detergent granules to be produced in the process of the present invention may preferably have the following properties.

(1) Bulk density: from 0.6 to 1.2 g/ml, preferably from 0.7 to 1.0 g/ml.

If the density exceeds 1.2 g/ml, it would result in poor solubility of the detergent granules.

The bulk density can be measured by a method as defined by JIS K 3362.

(2) Mean particle size: from 250 to 800 μm, preferably from 300 to 600 μm (the mean particle size can be measured in a similar manner as the particle size of the spray-dried particulate).

If the size is smaller than 250 μm, generation of dust would be caused, whereas if the size is larger than 800 μm, it would result in poor solubility of the detergent granules.

(3) Fluidity: 10 seconds or less when evaluated by measuring the time required for dropping of 100 ml of powder flowing out from a funnel of an apparent density measurement apparatus as set forth in JIS K 3362-1990, wherein the dropping funnel has an inner diameter of 9.5 mm.

If the fluidity exceeds 10 seconds, handling property of the detergent granules deteriorates.

(4) Non-caking property: 90% or more of sieve permeability defined below.

If non-caking property (permeability) is less than 90% the detergent granules will cause caking during storage.

Though mean particle size of granules obtained by the aforementioned step (2) ranges from 250 to 1,000 μm, the nonionic detergent granules of the present invention may preferably have a mean particle size of from 250 to 800 μm. The process of the present invention has another advantage in that aggregated granules once formed during the granulation step are cracked and separated into granules of proper size during the subsequent surface coating step in which the surface of the granulation product is coated with fine particles having a mean particle size of 10 μm or less.

The nonionic detergent granules obtained in the process of the present invention may be used in combination with a granular detergent in which an anionic active agent is used as a main base material.

The following examples are provided to illustrate the invention further in detail, but not by way of limitation.

EXAMPLE 1

Lödige Mixer (20 liter capacity; the average clearance between the agitation impeller and the inner wall of the mixer: 5.0 mm; manufactured by Matsuzaka Giken Co., Ltd.) was charged with 20 parts by weight of zeolite 4A and 65 parts by weight of sodium carbonate, and agitation by the main shaft (200 rpm) and a chopper (4,000 rpm) was started. To this was added 15 parts by weight of a nonionic surfactant over one minute, and the agitation was stopped at the 4 minutes later. Thereafter, 15 parts by weight of zeolite 4A was added to the resulting granules and agitation was conducted for 30 seconds, followed by discharging the content in the mixer. In this instance, total charge of the materials was 4 kg.

The bulk density, the mean particle size, the fluidity and the non-caking property of the granules thus obtained were measured in the following manner.

The bulk density was measured by a method as defined by JIS K 3362.

The mean particle size was measured in a similar manner as the particle size of the spray-dried particulate.

The powder fluidity was evaluated by measuring the time required for dropping of 100 ml of powder from a hopper for the measurement of bulk density as defined by JIS K 3362, and by judging the fluidity as good when the time required is short.

The non-caking property was measured according to the following test method.

(1) Prepare a box with its upper side remained open (10.2 cm in length, 6.2 cm in width and 4 cm in height) with a sheet of a filter paper (Toyo No. 2), and fix the corners using a stapler.

(2) Charge the box with 50 g of a sample, and put 15 g in weight of an acryl resin plate and 250 g in weight of a lead plate (or iron plate) on the charged sample.

(3) Judge the caking condition after 7 days of standing of the sample in a thermo-hygrostat oven at a temperature of 30° C. and at a humidity of 80%.

In this instance, the non-caking property was judged by gently pouring the thus treated sample on a wire gauze (or a screen, 5 mm/5 mm mesh), measuring weight of powder passed through the wire gauze and calculating a permeability of the sample with the following formula.

$$\text{Permeability (\%)} = \frac{\text{weight (g) of passed powder}}{\text{total weight (g) of sample}} \times 100$$

EXAMPLE 2

A granular sample was prepared in the same manner as in Example 1 except that the composition shown in Table 1 was used, and physical properties of the sample were evaluated in the same manner as in Example 1. The results are shown in Table 1.

EXAMPLE 3

A granular sample was prepared in the same manner as in Example 1 except that the composition shown in Table 1 was used, and physical properties of the sample were evaluated in the same manner as in Example 1. The results are shown in Table 1.

COMPARATIVE EXAMPLE 1

Nauta Mixer, the screw of which was not located at the center thereof (30 liter capacity, manufactured by Hosokawa Micron Corp.), was charged with 20 parts by weight of zeolite 4A and 65 parts by weight of sodium carbonate, and agitation was started (20 rpm). To this was added 15 parts by weight of a nonionic surfactant over 5 minute, and the contents in the mixer were discharged after 15 minutes of agitation. In this instance, total charge of the materials was 5 kg. Physical properties of the thus obtained sample were evaluated in the same manner as in Example 1. The results are shown in Table 1.

COMPARATIVE EXAMPLE 2

A V blender was charged with 100 parts by weight of the granules obtained in Comparative Example 1 and 15 parts by weight of zeolite 4A. After mixing for 5 minutes, the contents in the blender were discharged. In this instance, total charge of the materials was 5 kg. Physical properties of the thus obtained sample were evaluated in the same manner as in Example 1. The results are shown in Table 1.

TABLE 1

| | Example | | | Comparative Example | |
|---|---|---|---|---|---|
| | 1 | 2 | 3 | 1 | 2 |
| Nonionic Surfactant (part by weight) | | | | | |
| Polyoxyethylene dodecyl ether (EOP* = 8; melting point: 15° C.; HLB: 10.14) | 15 | 15 | 10 | 15 | 15 |
| Builder (part by weight) | | | | | |
| Zeolite 4A (mean particle size: 3 μm) | 20 | 10 | 23 | 20 | 20 |
| Sodium carbonate (mean particle size: 290 μm) | 65 | 35 | 65 | 65 | 65 |
| Sodium sulfate (mean particle size: 80 μm) | — | 20 | — | — | — |
| Trisodium citrate (mean particle size: 210 μm) | — | 20 | — | — | — |
| Binder (part by weight) | | | | | |
| Polyethylene glycol (mean MW: 6,000) | — | — | 2 | — | — |
| Surface Coating Agent | | | | | |

TABLE 1-continued

| | Example | | | Comparative Example | |
|---|---|---|---|---|---|
| | 1 | 2 | 3 | 1 | 2 |
| (part by weight) | | | | | |
| Zeolite 4A (mean primary particle size: 3 μm) | 15 | 15 | 15 | — | 15 |
| Froude Number (Fr) | 2.6 | 2.6 | 2.6 | — | — |
| Nonionic Detergent Granules | | | | | |
| Bulk density (g/ml) | 0.85 | 0.82 | 0.855 | 0.66 | 0.65 |
| Mean particle size (μm) | 420 | 390 | 430 | 260 | 240 |
| Fluidity (sec.) | 7.9 | 8.0 | 7.7 | ** | ** |
| Non-caking property (permeability, %) | 100 | 100 | 100 | 65 | 72 |

Notes;
*: EOP means added mean mol numbers of ethylene oxide.
**: Not dropped

EXAMPLE 4

Lödige Mixer (20 liter capacity; the average clearance between the agitation impeller and the inner wall of the mixer: 5.0 mm; manufactured by Matsuzaka Giken Co., Ltd.) was charged with 20 parts by weight of zeolite 4A, 40 parts by weight of sodium carbonate and 10 parts by weight of the amorphous aluminosilicate ($0.8Na_2O.Al_2O_3.6.5SiO_2$), and agitation with the main shaft (200 rpm) and a chopper (4,000 rpm) was started. To this was added 30 parts by weight of a nonionic surfactant over one minute, and the agitation was stopped at the 4 minutes later. Thereafter, 15 parts by weight of zeolite 4A was added to the resulting granulation product and agitation was conducted for 30 seconds, followed by dicharging the contents in the mixer. In this instance, total charge of the materials was 4 kg.

Bulk density, mean particle size, fluidity and noncaking property of granules thus obtained were measured. The results are shown in Table 2.

EXAMPLE 5

A granular sample was prepared in the same manner as in Example 4 except that the composition shown in Table 2 was used, and physical properties of the sample were evaluated in the same manner as in Example 4. The results are shown in Table 2.

EXAMPLE 6

A granular sample was prepared in the same manner as in Example 4 except that the composition shown in Table 2 was used, and physical properties of the sample were evaluated in the same manner as in Example 4. The results are shown in Table 2.

COMPARATIVE EXAMPLE 3

Nauta Mixer (30 liter capacity, manufactured by Hosokawa Micron Corp.) was charged with 20 parts by weight of zeolite 4A, 40 parts by weight of sodium carbonate and 10 parts by weight of the amorphous aluminosilicate used in Example 4, and agitation was started (20 rpm). To this was added 30 parts by weight of a nonionic surfactant over 8 minute and agitation was conducted for 15 minutes, followed by discharging the contents in the mixer. In this instance, total charge of the materials was 5 kg. Physical properties of the thus obtained sample were evaluated in the same manner as in Example 4. The results are shown in Table 2.

COMPARATIVE EXAMPLE 4

A V blender was charged with 100 parts by weight of the granules obtained in Comparative Example 3 and 15 parts by weight of zeolite 4A and the contents in the blender were mixed for 5 minutes, followed by discharging the content in the mixer. In this instance, total charge of the materials was 5 kg. Physical properties of the thus obtained sample were evaluated in the same manner as in Example 4. The results are shown in Table 2.

TABLE 2

| | Example | | | Comparative Example | |
|---|---|---|---|---|---|
| | 4 | 5 | 6 | 3 | 4 |
| Nonionic Surfactant (part by weight) | | | | | |
| Polyoxyethylene dodecyl ether (EOP* = 8; melting point: 15° C.; HLB: 10.14) | 30 | 40 | 50 | 30 | 30 |
| Builder (part by weight) | | | | | |

TABLE 2-continued

| | Example | | | Comparative Example | |
|---|---|---|---|---|---|
| | 4 | 5 | 6 | 3 | 4 |
| Zeolite 4A (mean particle size: 3 μm) | 20 | 10 | — | 20 | 20 |
| Sodium carbonate (mean particle size: 290 μm) | 40 | 35 | 30 | 40 | 40 |
| Porous Oil Absorbing Carrier (part by weight) | | | | | |
| Amorphous alminosilicate (pore volume: 310 $cm^3$/100 g; specific surface area: 153 $cm^2$/g; oil absorption: 245 ml/100 g) | 10 | 15 | 20 | 10 | 10 |
| Surface Coating Agent (part by weight) | | | | | |
| Zeolite 4A (mean primary particle size: 3 μm) | 15 | 15 | 15 | — | 15 |
| Froude Number (Fr) | 2.6 | 2.6 | 2.6 | — | — |
| Nonionic Detergent Granules | | | | | |
| Bulk Density (g/ml) | 0.84 | 0.83 | 0.845 | 0.66 | 0.65 |
| Mean Particle Size (μm) | 400 | 380 | 450 | 250 | 235 |
| Fluidity (sec.) | 7.5 | 7.6 | 7.9 | ** | ** |
| Non-caking property (permeability (%)) | 100 | 100 | 100 | 64 | 70 |

Notes;
*: EOP means added mean mol numbers of ethylene oxide.
**: Not dropped

EXAMPLE 7

A slurry containing 50% by weight of water was subjected to spray-drying to obtain the spray-dried particulate having the following composition.

| | |
|---|---|
| Zeolite 4A | 13.9 parts by weight |
| Sodium carbonate | 5.0 parts by weight |
| Carboxymethyl cellulose | 0.1 part by weight |
| Moisture | 1.0 part by weight |

Lödige Mixer (20 liter capacity; the average clearance between the agitation impeller and the inner wall of the mixer: 5.0 nun; manufactured by Matsuzaka Giken Co., Ltd.) was charged with 20 parts by weight of the thus prepared spray-dried particulate, 25 parts by weight of zeolite 4A and 40 parts by weight of sodium carbonate, and agitation with the main shaft (200 rpm) and a chopper (4,000 rpm) was started. To this was added 15 parts by weight of a nonionic surfactant over one minute, and the agitation was stopped at the 4 minutes later. Thereafter, 15 parts by weight of zeolite 4A was added to the resulting mixture and agitation was conducted for 30 seconds, followed by discharging the contents in the mixer. In this instance, total charge of the materials was 4 kg.

Bulk density, mean particle size, fluidity and noncaking property of granules thus obtained were measured, with the results shown in Table 3.

EXAMPLE 8

A slurry containing 50% by weight of water was subjected to spray drying to obtain spray-dried particulate having the following composition.

| | |
|---|---|
| Zeolite 4A | 12.9 parts by weight |
| Sodium carbonate | 5.0 parts by weight |
| Fatty acid sodium salt | 1.0 part by weight |
| Carboxymethyl cellulose | 0.1 part by weight |
| Moisture | 1.0 part by weight |

Nonionic detergent granules were prepared in the same manner as in Example 7 except that the spray-dried particulate was replaced by 20 parts by weight of the thus prepared spray-dried particulate, and physical properties of the granules were evaluated in the same manner as in Example 7. The composition employed and the results of the evaluation are shown in Table 3.

EXAMPLE 9

Nonionic detergent granules were prepared in the same manner as in Example 7 except that an amorphous aluminosilicate ($0.8Na_2O.Al_2O_3.6.5SiO_2$; pore volume, 310 $cm^3$/100 g; specific surface area, 153 $m^2$/g; oil absorption, 245 ml/100 g) was further added, and physical properties of the granules were evaluated in the same manner as in Example 7. The composition employed and the results of the evaluation are shown in Table 3.

EXAMPLE 10

Nonionic detergent granules were prepared in the same manner as in Example 7 except that the spray-dried particulate prepared in Example 8 and the amorphous aluminosilicate used in Example 9 were used, and physical properties of the granules were evaluated in the same manner as in Example 7. The composition employed and the results of he evaluation are shown in Table 3.

COMPARATIVE EXAMPLE 5

Nauta Mixer (30 liter capacity, manufactured by Hosokawa Micron Corp.) was charged with 40 parts by weight of zeolite 4A and 45 parts by weight of sodium carbonate, and agitation was started (20 rpm). To this was added 15 parts by weight of a nonionic surfactant spending 5 minute and and agitation was further conducted for 15 minutes, followed by discharging the contents in the mixer. In this instance, total charge of the materials was 5 kg. Next, a V blender was charged with 100 parts by weight of the thus prepared granules and 15 parts by weight of zeolite 4A and agitation was conducted for 5 minutes, followed by discharging the contents in the blender. In this instance, total charge of the materials was 5 kg. Physical properties of the thus obtained granules were evaluated in the same manner as in Example 7. The results are shown in Table 3.

COMPARATIVE EXAMPLE 6

Nonionic detergent granules were prepared in the same manner as in Comparative Example 5 except that the amorphous aluminosilicate used in Example 9 was further added, and physical properties of the granules were evaluated in the same manner as in Example 7. The composition employed and the results of the evaluation are shown in Table 3.

TABLE 3

| | Example | | | | Comparative Example | |
|---|---|---|---|---|---|---|
| | 7 | 8 | 9 | 10 | 5 | 6 |
| Nonionic Surfactant (part by weight) | | | | | | |
| Polyoxyethylene dodecyl ether (EOP* = 8; melting point: 15° C.; HLB: 10.14) | 15 | 15 | 30 | 30 | 15 | 30 |
| Builder (part by weight) | | | | | | |
| Zeolite 4A (mean particle size: 3 μm) | 25 | 25 | 20 | 20 | 40 | 35 |
| Sodium carbonate (mean particle size: 290 μm) | 40 | 40 | 20 | 20 | 45 | 25 |
| Spray-Dried Particulate (part by weight) | | | | | | |
| Zeolite 4A | 13.9 | 12.9 | 13.9 | 12.9 | — | — |
| Sodium carbonate | 5.0 | 5.0 | 5.0 | 5.0 | — | — |
| Sodium fatty acid (average carbon number: 18) | — | 1.0 | — | 1.0 | — | — |
| CMC—Na | 0.1 | 0.1 | 0.1 | 0.1 | — | — |
| Moisture | 1.0 | 1.0 | 1.0 | 1.0 | — | — |
| Porous Oil Absorbing Carrier | | | | | | |
| Amorphous aluminosilicate (pore volume: 310 $cm^3$/100 g; specific surface area: 153 $m^2$/g; oil absorption: 245 ml/100 g) | — | — | 10 | 10 | — | 10 |
| Surface Coating Agent (part by weight) | | | | | | |
| Zeolite 4A (mean primary particle size: 3 μm) | 15 | 15 | 15 | 15 | 15 | 15 |
| Spray-Dried Particulate | | | | | | |
| Bulk density (g/ml) | 0.70 | 0.43 | 0.70 | 0.43 | — | — |
| Mean particle size (μm) | 210 | 220 | 210 | 220 | — | — |
| Froude Number (Fr) | 2.6 | 2.6 | 2.6 | 2.6 | — | — |
| Nonionic Detergent Granules | | | | | | |
| Bulk density (g/ml) | 0.81 | 0.72 | 0.80 | 0.70 | 0.67 | 0.64 |
| Mean particle size (μm) | 390 | 410 | 405 | 420 | 240 | 230 |
| Fluidity (sec.) | 7.7 | 7.8 | 7.6 | 7.8 | ** | ** |
| Non-caking property (permeability (%)) | 100 | 100 | 100 | 100 | 63 | 69 |

Notes;
*: EOP means added mean mol numbers of ethylene oxide.
**: Not dropped

EXAMPLE 11

Flexo Mix 160 (manufactured by Powrex Corp.) was continuously charged with 25 parts by weight of zeolite 4A, 65 parts by weight of sodium carbonate and 10 parts by weight of a nonionic active agent in a total charge of 300 kg/hr, while mixing with the main agitation shaft at a speed of 2,000 rpm. In this instance, the nonionic surfactant to be charged was controlled at a temperature of 70° C. and sprayed into the vessel using a binary fluid nozzle (air pressure: 3 kg/$cm^2$).

The thus mixed detergent materials were continuously charged into Lödige Mixer KM-150D (150 1 capacity; the average clearance between the agitation impeller and the inner wall of the mixer: 5.5 mm; manufactured by Matsuzaka Giken Co., Led.) and granulated with a main shaft rotating speed of 100 rpm, a chopper rotation of 3,440 rpm and a mean residence time of 3.5 minutes.

Next, 100 parts by weight of the thus granulated detergent material and 15 parts by weight of zeolite 4A were continuously charged into a continuous mixer (manufactured by Kao Corp.; 40 liter capacity) which has similar structure to the aforementioned Lödige Mixer and mixed with a main shaft rotating speed of 130 rpm, a chopper rotation of 4,000 rpm and a mean residence time of 0.75 minute.

Bulk density, mean particle size, fluidity and noncaking property of the thus obtained granules were measured. The results are shown in Table 4.

EXAMPLE 12

The process of Example 11 was repeated except that corresponding detergent materials shown in Table 4 were charged, and physical properties of the resulting granules were evaluated in the same manner as in Example 11. The composition employed and results of the evaluation are shown in Table 4.

EXAMPLE 13

The process of Example 11 was repeated except that the detergent materials shown in Table 4 were charged, and physical properties of the resulting granules were evaluated in the same manner as in Example 11. The composition employed and results of the evaluation are shown in Table 4.

EXAMPLE 14

The process of Example 11 was repeated except that the detergent materials shown in Table 4 were charged, and physical properties of the resulting granules were evaluated in the same manner as in Example 11. The composition employed and results of the evaluation are shown in Table 4.

EXAMPLE 15

The same detergent materials used in Example 11 were continuously charged into Lödige Mixer KM-150D (manufactured by Matsuzaka Giken Co., Led.), and mixing and granulation were carried out simultaneously. The operation was carried out with a total charge of 300 kg/hr, a main shaft rotating speed of 100 rpm, a chopper rotation of 3,440 rpm and a mean residence time of 4.0 minutes. In this instance, the nonionic surfactant to be charged was controlled at a temperature of 70° C. and sprayed toward rotating area of the chopper, using a binary fluid nozzle (air pressure: 3 kg/cm$^2$).

A step for the surface coating of granules and evaluation of physical properties of the granules were carried out in the same manner as in Example 11. The composition employed and results of the evaluation are shown in Table 4.

EXAMPLE 16

The procedure of Example 11 was repeated except that the detergent material shown in Table 4 was charged, and physical properties of the resulting granules were evaluated in the same manner as in Example 11.

TABLE 4

| | Example | | | | | |
|---|---|---|---|---|---|---|
| | 11 | 12 | 13 | 14 | 15 | 16 |
| Nonionic Surfactant (part by weight) | | | | | | |
| Polyoxyethylene dodecyl ether (EOP* = 8; melting point: 15° C.; HLB: 10.14) | 10 | 30 | 15 | 30 | 10 | 30 |
| Builder (part by weight) | | | | | | |
| Zeolite 4A (mean particle size: 3 μm) | 25 | 20 | 25 | 20 | 25 | 20 |
| Sodium carbonate (mean particle size: 290 μm) | 65 | 40 | 40 | 20 | 65 | 40 |
| Spray-Dried Particulate (prepared in Example 8) (part by weight) | | | | | | |
| Zeolite 4A | — | — | 12.9 | 12.9 | — | — |
| Sodium carbonate | — | — | 5.0 | 5.0 | — | — |
| Spray-Dried Particulate (prepared in Example 8) (part by weight) | | | | | | |
| Sodium fatty acid (average carbon number: 18) | — | — | 1.0 | 1.0 | — | — |
| CMC—Na | — | — | 0.1 | 0.1 | — | — |
| Moisture | — | — | 1.0 | 1.0 | — | — |
| Porous Oil Absorbing Carrier (part by weight) | | | | | | |
| Amorphous alminosilicate*2 (pore volume: 310 cm$^3$/100 g; specific surface area: 153 m$^2$/g; oil absorbing capacity: 245 ml/100 g) | — | 10 | — | 10 | — | 10 |
| Surface Coating Agent (part by weight) | | | | | | |
| Zeolite 4A | 15 | 15 | 15 | 15 | 15 | — |

TABLE 4-continued

| | Example | | | | | |
|---|---|---|---|---|---|---|
| | 11 | 12 | 13 | 14 | 15 | 16 |
| (mean primary particle size: 3 μm) | | | | | | |
| Amorphous aluminosilicate | — | — | — | — | — | 5 |
| (mean primary particle size: 50 nm) | | | | | | |
| Spray-Dried Particulate | | | | | | |
| Bulk density (g/ml) | — | — | 0.43 | 0.43 | — | — |
| Mean particle size (μm) | — | — | 220 | 220 | — | — |
| Froude Number (Fr) | 1.5 | 1.5 | 1.5 | 1.5 | 1.5 | 1.5 |
| Mean Residence Time (min.) | | | | | | |
| Step (2) | 3.5 | 3.2 | 3.0 | 3.1 | 4.0*3 | 3.2 |
| Step (3) | 0.75 | 0.75 | 0.75 | 0.75 | 0.75 | 0.75 |
| Nonionic Detergent Granules | | | | | | |
| Bulk density (g/ml) | 0.85 | 0.84 | 0.74 | 0.72 | 0.84 | 0.82 |
| Mean particle size (μm) | 415 | 380 | 400 | 395 | 405 | 385 |
| Fluidity (sec.) | 7.6 | 7.2 | 7.5 | 7.3 | 7.7 | 7.4 |
| Non-caking property (permeability (%)) | 100 | 100 | 100 | 100 | 100 | 100 |

Notes;
*1: EOP means added mean mol numbers of ethylene oxide.
*2: $0.8Na_2O.Al_2O_3.6.5SiO_2$
*3: Mean residence time when mixing and granulation are carried out in a single vessel.

In all Examples 1 to 16, formation of an adhesion layer of the detergent material was found between the inner wall of the mixing vessel of the mixer and the agitation impeller when inside of the mixer is observed during the granulation step through a nozzle area on the upper side of the mixer.

As has been described in the foregoing, the nonionic -detergent granules containing a nonionic surfactant in a high content and having high bulk density and excellent powder fluidity and non-caking property can be produced in the process of the present invention with less suffering from compositional restrictions of the material.

While the invention has been described in detail and with reference to specific examples thereof, it will be apparent to one skilled in the art that various changes and modifications can be made therein without departing from the spirit and scope thereof.

What is claimed is:

1. A process for producing nonionic detergent granules having a bulk density of from 0.6 to 1.2 g/ml which comprises the following steps (1) to (3):

(1) mixing a detergent material comprising a nonionic surfactant;

(2) granulating a mixture obtained in said step (1) by agitating in an agitating mixer provided at the center position thereof with a rotation shaft having an agitation impeller with a clearance between the agitation impeller and an inner wall of the mixer of from 1 to 30 mm, wherein the agitation impeller agitates the mixture at a Froude number of from 1 to 4 to form a layer of said mixture on said inner wall of said mixer so as to increase a bulk density of granules of the mixture, step (2) being carried out for a period of time sufficient to granulate said mixture obtained in said step (1), whereafter step (3) is carried out; and (3) mixing the granules obtained in said step (2) with from 0.5 to 30 parts by weight of fine particles of a silicate compound or a metal soap having a mean primary particle size of 10 μm or less to thereby coat the surface of the granules with the fine particles, whereby the nonionic detergent granules have excellent powder fluidity and non-caking property, wherein said detergent material is selected from the following materials (b) and (d):

(b) a detergent material comprising from 20 to 89 parts by weight of a builder, from 1 to 20 parts by weight of a porous oil absorbent carrier and from 10 to 60 parts by weight of a nonionic surfactant; and (d) a detergent material comprising from 20 to 89 parts by weight of a mixture of a builder and a spray-dried particulate wherein a weight ratio of the builder to the spray-dried particulate is from 5:95 to 95:5, from 1 to 20 parts by weight of a porous oil absorbent carrier, and from 10 to 60 parts by weight of a nonionic surfactant;

wherein said builder is an organic or inorganic powder builder, said spray-dried particulate is obtained by spray-drying a slurry comprising an organic or inorganic builder and a surfactant selected from the group consisting of anionic, cationic, and nonionic surfactants, and said porous oil absorbent carrier has a pore volume of from 100 to 600 $cm^3$/100 g measured in a mercury porosimeter, a specific surface area of from 20 to 700 $m^2$/g measured by the BET method and an oil absorption of 100 ml/100 g or more, wherein said oil absorption is measured by determining a quantity of boiled linseed oil absorbed to the porous oil absorbent carrier.

2. A process of claim 1, wherein granulation in said step (2) is carried out for 0.5 to 20 minutes.

3. A process of claim 1, wherein said agitating mixer in said step (2) is an agitating mixer having a horizontal mixing cylinder provided with an agitation shaft at the center of the cylinder in which mixing of materials is effected by an impeller attached to the agitation shaft.

4. A process of claim 1, wherein said step (1) and (2) are carried out in a single apparatus.

5. A process of claim 1, wherein said steps (1), (2) and (3) are carried out in a single apparatus.

6. A process of claim 1, wherein said steps (1), (2) and (3) are carried out in batchwise operation.

7. A process of claim 1, wherein said steps (1), (2) and (3) are carried out in continuous operation.

8. A process of claim 7, wherein said steps (1) and (2) are carried out simultaneously in a single apparatus.

9. A process of claim 1, wherein said nonionic surfactant is a polyoxyethylene alkyl ether of a straight-chain or branched, primary or secondary alcohol having from 10 to 20 carbon atoms with ethylene oxides in a mean added mol number of from 5 to 15.

10. A process of claim 1, wherein said builder is a compound or a mixture of two or more of compounds selected from sodium tripolyphosphate, sodium carbonate, aluminosilicates, silicate compounds having an ion-exchanging ability of 100 or more in terms of $CaCO_3$ mg/g, citrates, polyacrylates and polyethylene glycols.

11. The process of claim 1, wherein said slurry which is spray-dried to obtain said particulate in (d) is prepared by spray-drying a slurry comprising water, said organic or inorganic builder and said surfactants and wherein said organic or inorganic builder is a compound or a mixture of two or more of compounds selected from sodium tripolyphosphate, sodium carbonate, aluminosilicates, silicate compounds having an ion-exchanging ability of 100 or more in terms of $CaCO_2$ mg/g, citrates, polyacrylates, and polyethylene glycols.

12. A process of claim 1, wherein said porous oil absorbing carrier is an amorphous silica derivative.

13. A process of claim 12, wherein said amorphous silica derivative is an amorphous aluminosilicate.

14. A process of claim 1, wherein said fine particles having a mean primary particle size of 10 μm or less comprise a compound or a mixture of two or more silicate compounds selected from the group consisting of alumino silicates and amorphous silica derivatives.

15. A process of claim 1, wherein said nonionic detergent granules have a mean particle size of from 250 to 800 m.

16. A process of claim 1, wherein said nonionic detergent granules have a fluidity of 10 seconds or less, wherein said fluidity is measured by determining a period of time necessary for 100 ml of the nonionic detergent granules flowing out from a funnel of an apparent density measuring apparatus as set forth in JIS K 3362-1990, wherein said funnel has an inner diameter of 9.5 mm.

17. A process of claim 1, wherein said nonionic detergent granules have a non-caking property of 90% or more in terms of sieve permeability.

18. A process of claim 1, wherein granulation in said step (2) is carried out for 3 to 10 minutes.

19. A process of claim 1, wherein said Froude number is from 1.2 to 3.

* * * * *